US006405457B1

(12) United States Patent
Basso et al.

(10) Patent No.: US 6,405,457 B1
(45) Date of Patent: Jun. 18, 2002

(54) SPORTS BOOT

(75) Inventors: Fabio Basso, Treviso; Bruno Borsoi, Victorio Veneto, both of (IT)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/469,357

(22) Filed: Dec. 22, 1999

(30) Foreign Application Priority Data

Dec. 23, 1998 (FR) ..... 98 16516

(51) Int. Cl.[7] ..... A43B 5/00

(52) U.S. Cl. ..... 36/89; 36/117.1; 36/10; 36/119.1

(58) Field of Search ..... 36/89, 115, 117.1, 36/117.6, 119.1, 10, 55

(56) References Cited

U.S. PATENT DOCUMENTS

| | | | | | |
|---|---|---|---|---|---|
| 1,084,197 | A | * | 1/1914 | Collis | 36/89 |
| 2,165,879 | A | * | 7/1939 | Wilkinson | 36/89 |
| 3,028,861 | A | * | 4/1962 | Shapiro | 36/89 |
| 3,710,484 | A | * | 1/1973 | Heitzinger | 36/117.1 |
| 4,308,674 | A | * | 1/1982 | Tessaro | 36/117.1 |
| 4,458,373 | A | * | 7/1984 | Maslow | 36/50.1 |
| 5,499,461 | A | | 3/1996 | Danezin et al. | 36/117 |
| 5,575,015 | A | * | 11/1996 | Paris et al. | 36/117.1 |
| 5,609,347 | A | * | 3/1997 | Dressel | 280/14.2 |
| 5,761,835 | A | * | 6/1998 | Okajima | 36/89 |
| 5,771,609 | A | | 6/1998 | Messmer | 36/89 |
| 5,887,361 | A | | 3/1999 | Cabanis et al. | 36/115 |
| 5,946,827 | A | * | 9/1999 | Okajima | 36/117.6 |

FOREIGN PATENT DOCUMENTS

| | | |
|---|---|---|
| DE | 3622746 | 1/1988 |
| EP | 0753267 | 1/1997 |
| EP | 0753270 | 1/1997 |
| FR | 2752685 | 3/1998 |
| FR | 2765778 | 1/1999 |
| WO | WO97/45033 | 12/1997 |

* cited by examiner

*Primary Examiner*—M. D. Patterson
(74) *Attorney, Agent, or Firm*—Greenblum & Bernstein, P.L.C.

(57) ABSTRACT

A removable reinforcing element for a sports boot, particularly a snowboarding boot, of the type including an outer boot and an inner liner, the outer boot including an external sole and an external upper, the inner liner including a close-fitting envelope covering the foot and the leg. The reinforcing element includes a bottom part forming a heel stiffener and equipped with a tightening arrangement exerting a tightening force at the level of the instep. It also includes a top part extending vertically upward from the bottom part and including a rear wall and two lateral walls surrounding the lower leg.

10 Claims, 4 Drawing Sheets

20
10
13
14
11
30
12

SPORTS BOOT

BACKGROUND OF THE INVENTION

1. Field of the Invention

The present invention is directed to a reinforcing element for a sports boot, particularly for a gliding sport, such as snowboarding.

2. Description of Background and Relevant Information

In sports of the aforementioned type, and especially in snowboarding, the boot that ensures the connection of the user's foot and leg to the gliding apparatus must reconcile the need for flexibility, for purposes of comfort and flexion in certain directions, with the need for rigidity in other directions to limit the flexion of the leg in those directions, in order to provide a sufficient stability of the user's ankle and lower leg.

In snowboarding, the support and flexion-limiting functions are generally fulfilled by the binding system of the boot and snowboard, which is constituted by rigid elements forming a shell that more or less surrounds the boot.

This type of binding makes it possible to keep boots that are very flexible.

Moreover, these boots are generally constituted by a shoe, or outer boot, including an external sole and an external upper, and by an inner liner, i.e., an extremely flexible envelope completely covering the foot and the lower leg and adapted to provide the necessary comfort.

These inner liners have the drawback of breaking down over the course of their use due to the flexibility of the materials that constitute them and the repeated stresses to which they are subjected, particularly during the tightening of the boot and of the binding. Various solutions have been proposed for overcoming these drawbacks.

Thus, marketed under the trade name Dakine, there is a plastic heel reinforcement associated with an instep tightening strap, adapted for being inserted into a snowboarding boot between the inner liner and the external upper in order to rigidify the heel area and to prevent the breakdown of the liner caused by the tightening on the top of the liner.

A reinforcement of this type certainly makes it possible to solve a local problem of the breakdown of the liner in the area of the heel, but does not solve the other problems mentioned above.

International Patent Publication WO 97/45033 discloses a reinforcing device for a ski boot or snowboarding boot having a substantially L-shaped profile and adapted for being inserted into the boot so as to extend continuously underneath the sole of the foot and behind the lower leg.

A device of this type certainly makes it possible to increase the front-to-back rigidity of the boot but does not solve the other problems listed above.

In particular, it does not provide any support in the transverse direction, and does not solve the problem of the breakdown of the liner. Another problem, which is encountered especially in snowboarding but can also occur in other gliding sports, is that depending on the half-pipe, freeriding, and freestyle maneuvers practiced, the user will want the rigidity of the boot to be different, both in terms of direction and intensity.

SUMMARY OF THE INVENTION

An object of the present invention is to overcome the aforementioned drawbacks and to provide an improved reinforcing element that specifically makes it possible to solve the problem of the breakdown of the liner, and/or to provide improved rigidity/flexural strength in the preferred directions.

Another object of the present invention is to also allow easy adaptation of a boot for a gliding sport, especially snowboarding, to different types of maneuvers.

This object is achieved by the reinforcing element according to the invention, which is the type that includes an outer boot and an inner liner, the outer boot including an external sole and an external upper, the inner liner including a close-fitting envelope covering the foot and the leg, the reinforcement including a bottom part forming a heel stiffener and equipped with a tightening strap in order to prevent the breakdown of the upper and to hold the heel in place, wherein the reinforcement also includes a top part extending upwardly from the bottom part and including a dorsal, or rear, wall and two lateral walls surrounding the lower leg.

In effect, such a reinforcing element contributes to the lateral support of the user's lower leg, while preventing the breakdown of the liner, particularly in the heel area.

According to a preferred embodiment, each of the lateral walls is equipped on its front edge with an arrangement for connecting to the liner. A structure of this type actually makes it possible to increase the stiffness of the liner/boot assembly in the longitudinal direction—as well as from front to back—because of the reinforcing element/liner affixing obtained.

Accordingly, the invention provides for a removable reinforcing element for a sports boot, particularly a snowboarding boot, of the type comprising an outer boot and an inner liner, the outer boot comprising an external sole and an external upper, the inner liner comprising a close-fitting envelope covering the foot and the leg, the reinforcing element comprising a bottom part forming a heel stiffener and equipped with a tightening arrangement exerting a tightening force in the area of the instep, wherein the reinforcement also comprises a top part extending vertically upward from the bottom part and comprising a rear wall and two lateral walls surrounding the lower leg. Each of the lateral walls being equipped on its front edge with a respective connection between the liner and the boot. The inner liner, respectively of the boot, being equipped with a tightening arrangement by lacing, respectively, and in that the connection is constituted by keepers capable of receiving the lace of the liner, respectively of the boot. The connection being constituted by a keeper/lace system. That a lace grip is associated with the respective lacing system. The reinforcing element having a stiffness greater than that of the liner in at least a transverse or longitudinal direction. The reinforcing element having a stiffness that is variable as a function of the desired type of practice. The reinforcing element being inserted between the outer boot and the inner liner. The reinforcing element being arranged outside the outer boot.

The invention also provides for a boot incorporating a reinforcing element of the type comprising an outer boot and an inner liner, the outer boot comprising an external sole and an external upper, the inner liner comprising a close-fitting envelope covering the foot and the leg, the reinforcing element comprising a bottom part forming a heel stiffener and equipped with a tightening arrangement exerting a tightening force in the area of the instep, wherein the reinforcement also comprises a top part extending vertically upward from the bottom part and comprising a rear wall and two lateral walls surrounding the lower leg.

BRIEF DESCRIPTION OF DRAWINGS

The invention will be better understood and its other characteristics will be further apparent with the assistance of the following description with reference to the accompanying drawing, illustrating several non-limiting exemplary embodiments, in which.

DETAILED DESCRIPTION OF THE INVENTION

Figure 1:
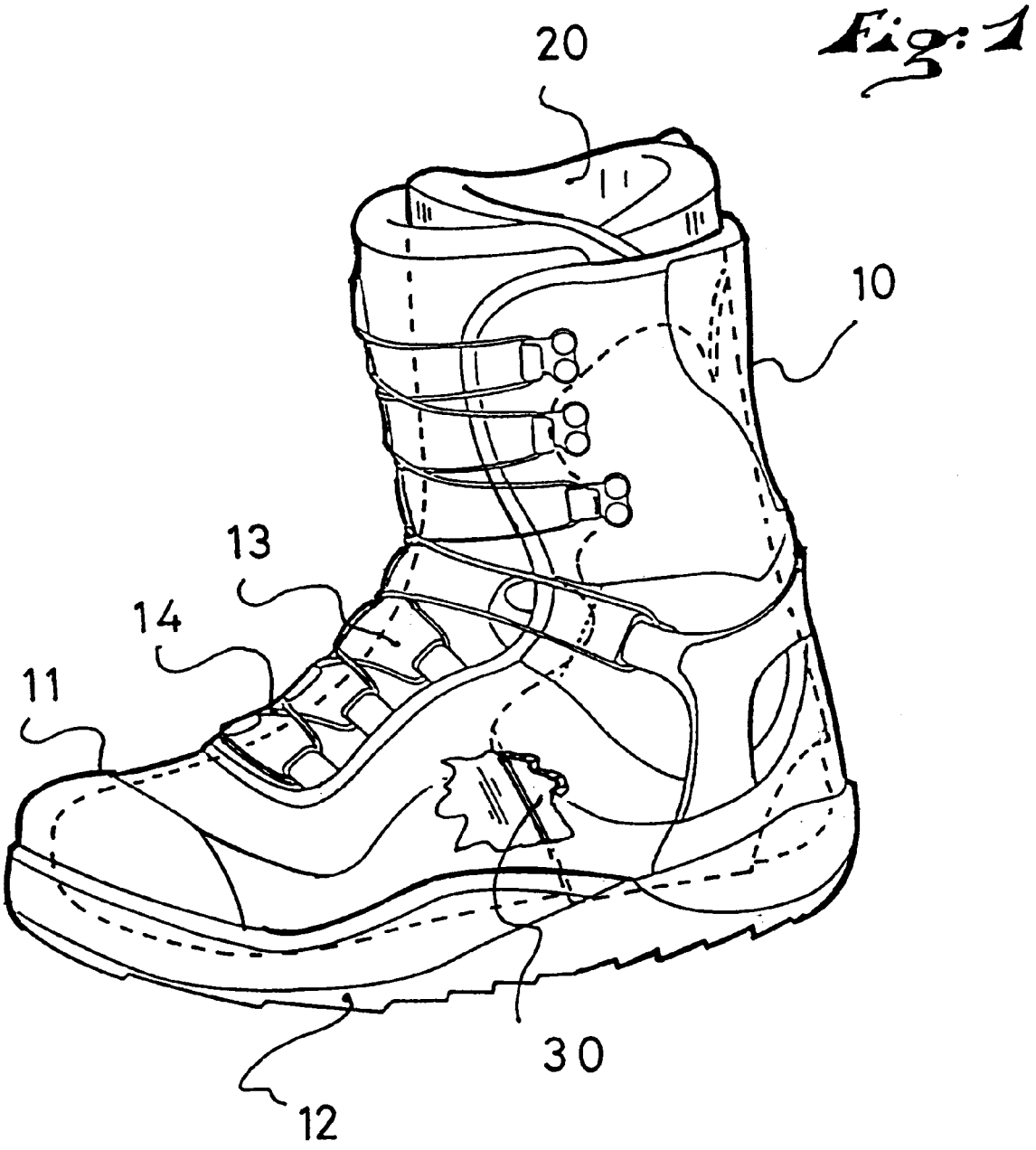
FIG. 1 is a perspective view, with a partial cutaway, of a boot incorporating a liner and a reinforcing element.

FIG. 1 shows a boot incorporating the reinforcing element according to the invention. This boot is composed of an outer shoe 10 of the boot type, an inner liner 20, and a reinforcing element 30.

The outer boot 10 is constituted by an external upper 11 and an external sole 12. The external upper 11 is a high-top upper that rises above the ankle and surrounds the user's lower leg. It is equipped at the front with a longitudinal opening 13 adapted so as to allow the insertion/removal of the foot and equipped with fastening element or device, such as a lacing 14.

The external upper 11 is preferably made of a flexible material such as leather or thick textile, which nevertheless has abrasion—and wear-resistant qualities and a certain mechanical strength.

Figure 2:
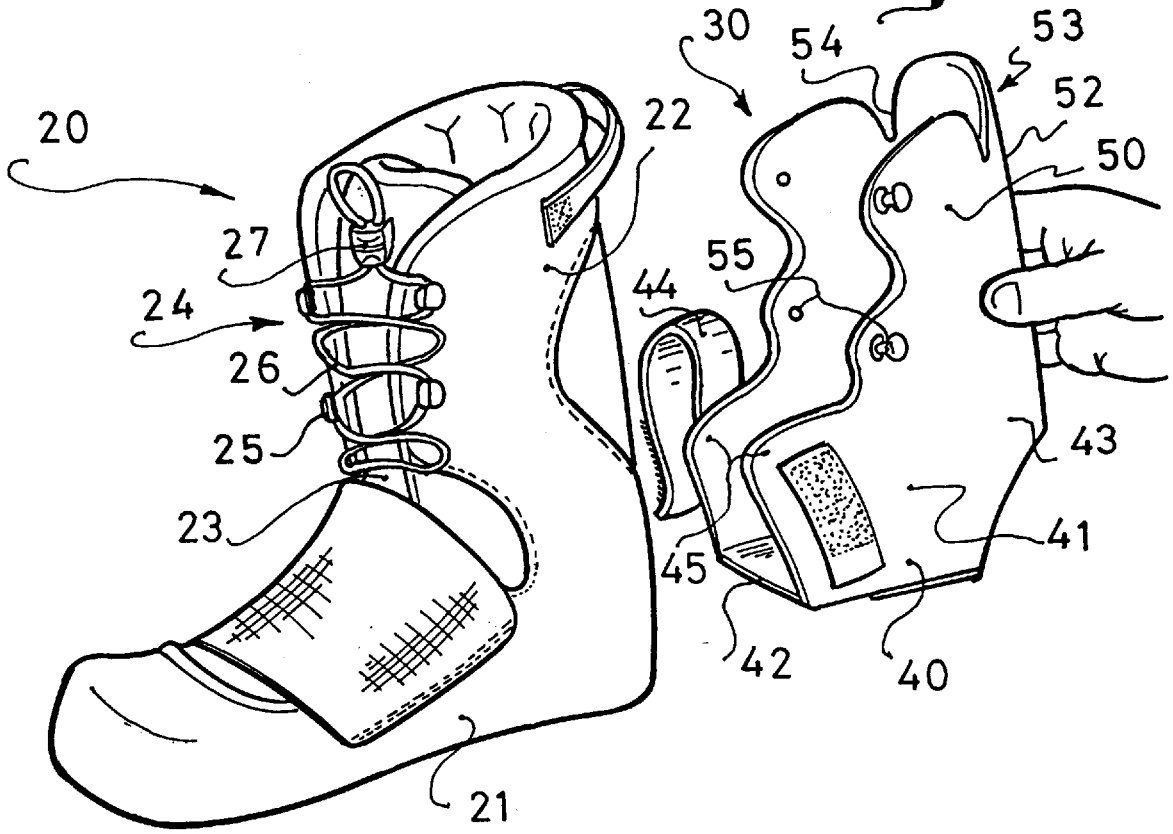
FIG. 2 is a perspective view of a liner and a reinforcing element before assembly.
Figure 3:
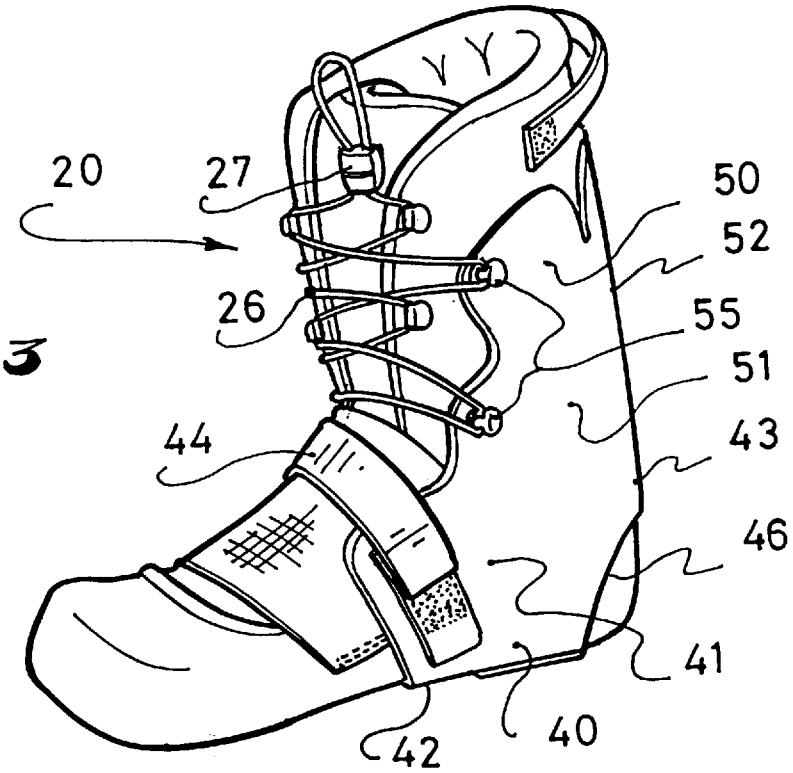
FIG. 3 is a view similar to FIG. 2 of a liner and a reinforcing element after assembly.

As illustrated specifically by FIGS. 2 and 3, the inner liner 20 is constituted by a close-fitting envelope including a bottom part 21 covering the foot and a top part 22 covering the lower leg, these two parts being joined in continuous fashion. At the front, the liner 20 also includes a longitudinal opening 23 for the insertion of the foot, with which is associated a lace tightening system 24 constituted by a series of fixed keepers 25 on each side of the edges of the longitudinal opening 23, and receiving a lace 26.

According to a preferred embodiment, though not mandatory, a lace grip 27 is associated with the end of the lace 26.

A traditional lacing, without a grip 27, could also be provided, as well as other tightening device—for example, of the self-gripping, i.e., the hook and loop fastening type—without leaving the scope of the present invention.

The liner 20 is made of any material that provides the desired flexibility and comfort, particularly a PE or PU foam, or the like.

The reinforcing element 30 includes a bottom part 40 forming a heel stiffener and a top part 50.

The bottom part 40 includes two lateral walls 41 joined by a sole part 42 adapted for being placed underneath the foot part 21 of the liner 20 and a rear band 43 surrounding the top of the heel and joining the two lateral walls 41 at the rear.

Each lateral wall 41 extends vertically along the user's foot from his plantar area up to his instep area.

The two walls 41 are equipped, in the area of their top edge 45, with a fastening mechanism, in this case a system of self-gripping straps 44, which extend into the user's instep area and allow a tightening around the foot by way of a relative drawing together of the edges 45 of these walls.

The area of the bottom part 40 corresponding to the heel itself includes a cutout 46 for greater comfort.

The top part 50 of the stiffener includes two lateral walls 51 extending vertically from the cutout 46 and the rear band 43 so as to surround and support the user's lower leg. The two lateral walls 51 are joined at the rear by a rear wall 52.

Each of the lateral walls 51 includes on its front edge an arrangement for connecting to the liner 20, in this case constituted by an arrangement for the passage of the lace 26 of the liner 20, i.e., keepers 55.

These keepers 55 can thus cooperate in the tightening with the lace 26 of the liner, the latter passing alternately through the keepers 25 of the liner and those 55 of the reinforcing element 30.

In this way, the top part 50 of the reinforcement 30 contributes not only to a lateral retention, i.e., in the transverse direction, of the ankle and the lower leg, but also, because of its participation in the tightening of the liner, provides flexural resistance, both toward the front and toward the back of the leg.

The top part 50 also makes it possible to adjust the stiffness of the boot, in front/rear flexion, as well as to provide a rear support.

In fact, without the reinforcing element 30 the boot can be very flexible, whereas the addition of this reinforcing element makes it possible to stiffen it both in the transverse direction and in the longitudinal direction.

Depending on the type of snowboarding practiced, different reinforcing elements 30, with varying levels of stiffness both in the longitudinal and transverse direction, can be provided in order to adapt the stiffness of the boot to the type of practice. In all cases, the stiffness of the reinforcing element 30 will be greater than that of the liner 20 in at least a longitudinal or transverse direction.

It is also noted that the rear part 52 is preferably equipped with vertical lateral slots 54 at its top part 53 in order to provide a progressive rear support.

Figure 4:
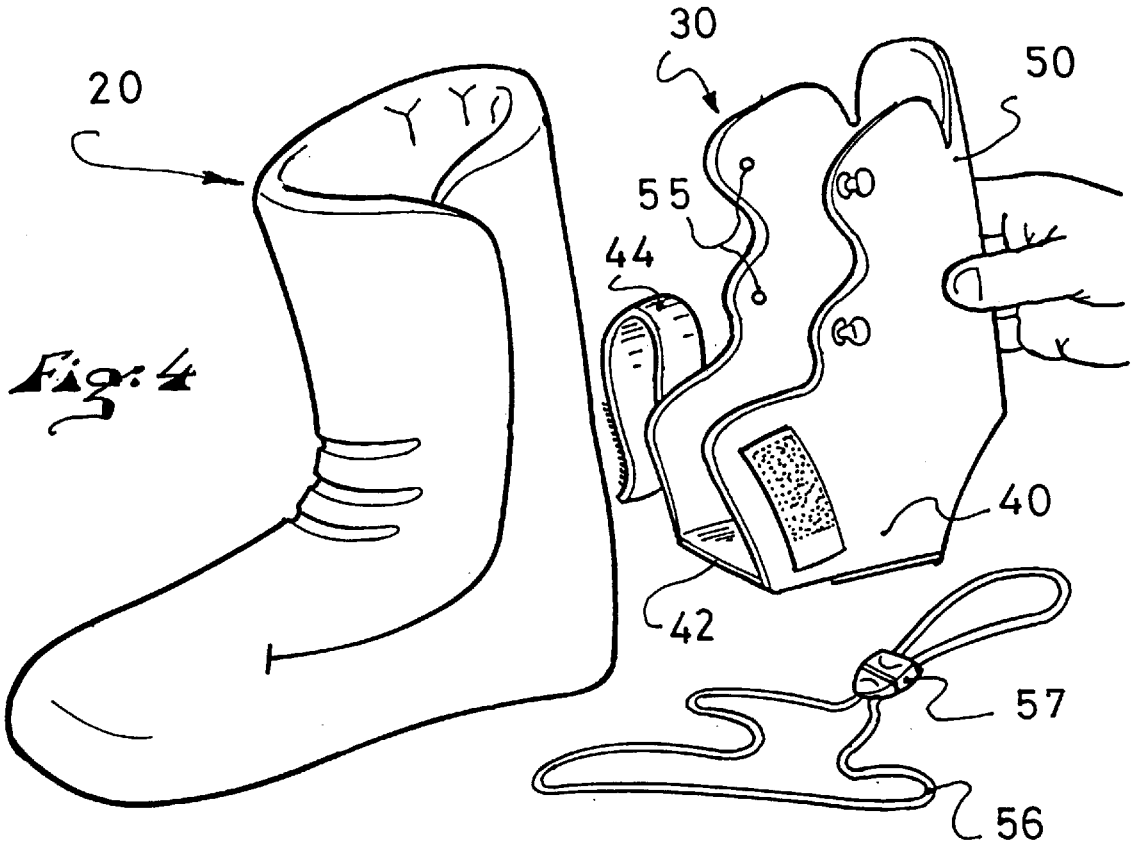
FIG. 4 is a view similar to FIG. 2 showing the embodiment of the invention with a liner of a different type.
Figure 5:
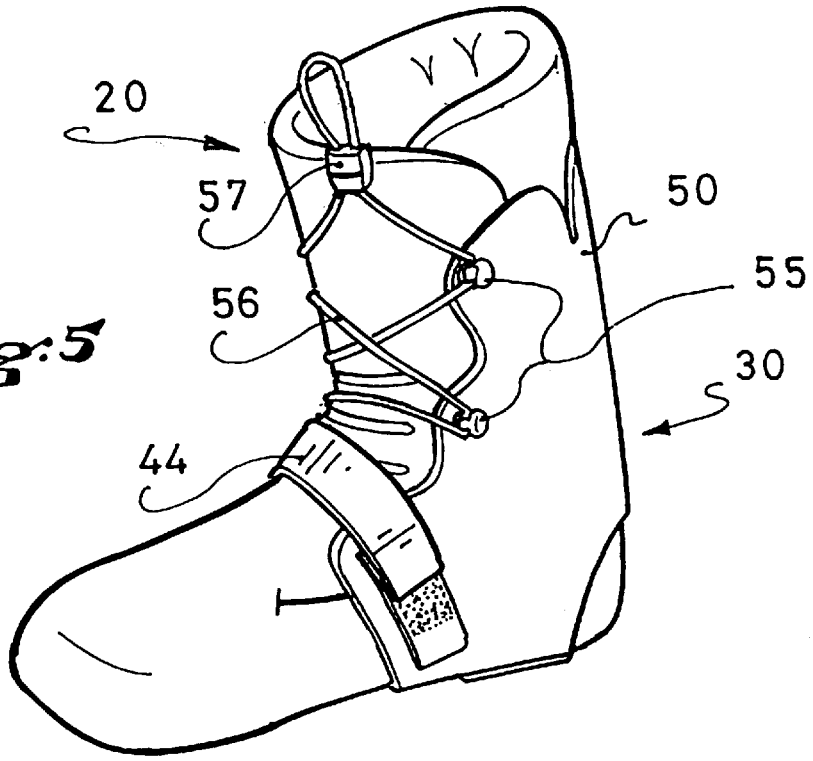
FIG. 5 is a view similar to FIG. 3 of the liner/reinforcing element assembly of FIG. 4.

FIGS. 4 and 5 illustrate the application of the reinforcement according to the invention to a snowboarding boot of the same type as that of FIGS. 1 through 3, the similar or equivalent elements being designated by the same references, the only difference residing in the fact that the inner liner 20 is the injected type with a lateral opening and has no lacing member(s).

In this case, the reinforcing element 30 includes, in addition to the keepers 55, a lace 56 with which a lace grip 57 is associated. This arrangement makes it possible to fasten the reinforcing element 30 onto the liner 20, even in the absence of a tightening mechanism on the latter, and to retain the forward and rearward stiffening and rear support functions mentioned above.

In both embodiments described, the lacing system is a quick lacing system with a lace, respectively 26, 56, and a lace grip, respectively 27, 57. In this case, the separation of the reinforcing element 30 relative to the liner by unfastening can be easily and quickly obtained by releasing the grip, respectively 56, 57, and by pulling it up along the lace, respectively 26, 27, which makes it possible to considerably soften the top of the boot, and to render its front/rear flexibility more comfortable and easier to walk in.

Other tightening arrangements could be provided without leaving the scope of the present invention. In particular, it is possible to provide a tightening by means of a normal lace, i.e., without gripping the lace, or any other tightening method, for example, self-gripping elements, cables, etc.

Figure 6:
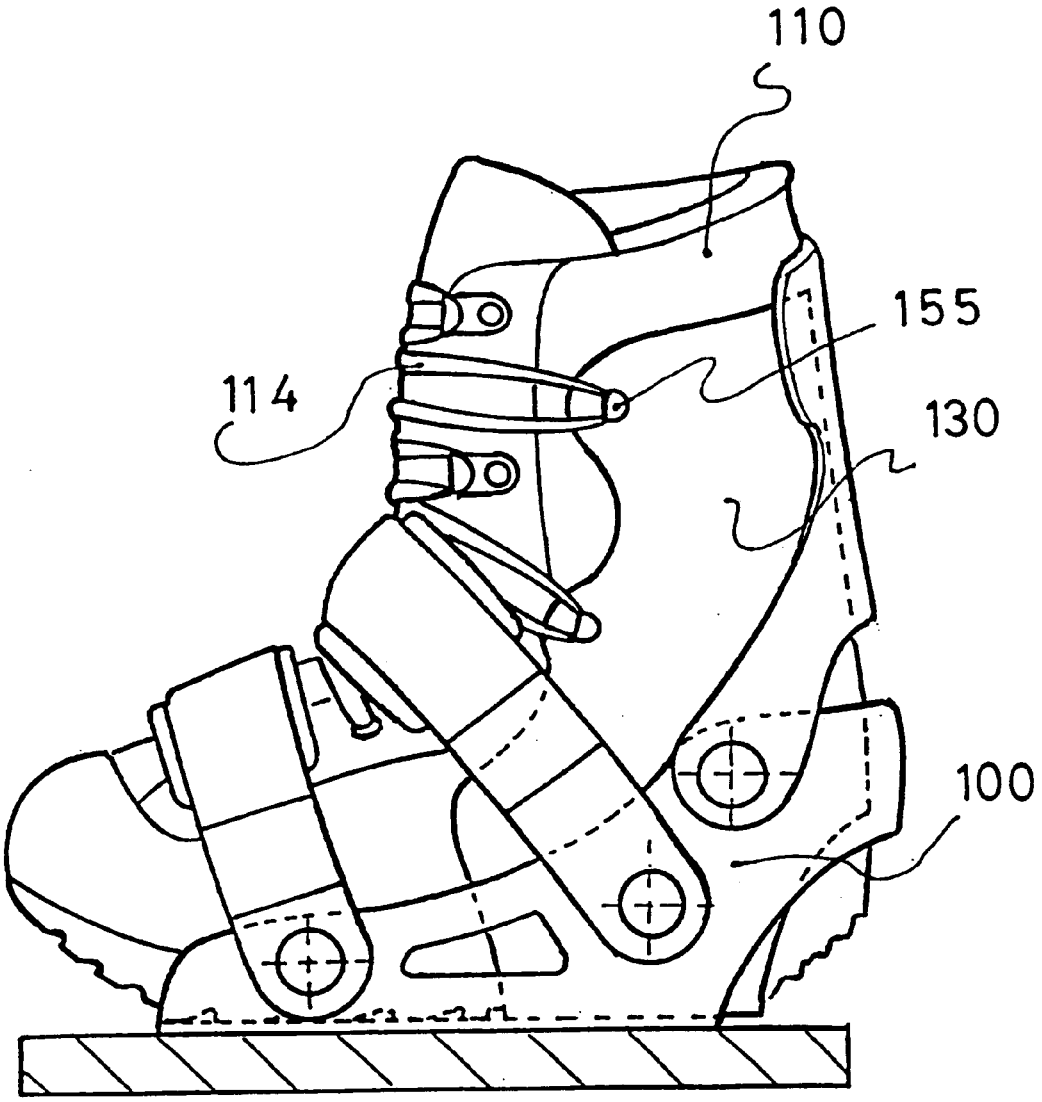
FIG. 6 is a view similar to FIG. 1 showing another exemplary application of the invention.

According to a final advantageous embodiment represented in FIG. 6, in which the similar or equivalent elements are designated by the same references increased by 100, the reinforcement 130 can be provided so as to be arranged outside the outer boot 110, i.e., between the latter and the binding device 100. In this case, the reinforcement 130 could also include keepers 155 capable of cooperating with lacing 114 of the outer boot 110 in order to participate in the tightening of the boot.

The present invention is not limited to the non-limiting exemplary embodiments described above, but includes all similar or equivalent embodiments. In particular, it is not limited to an application to a snowboarding boot, but extends to any type of sports boot, particularly for a gliding sport, such as skiing, roller skating, ice skating, etc., for which it is desirable to overcome the various problems and particularly to make it easy to vary the stiffness of the boot upper in the longitudinal and/or transverse direction as a function of the desired type of practice.

The instant application is based upon French Patent Application No. 98.16516, filed Dec. 23, 1998, the disclosure of which is hereby incorporated by reference thereto in its entirety, and the priority of which is hereby claimed under 35 USC 119.

What is claimed is:

1. A reinforced sports boot comprising:

an internal liner comprising a sole and an upper extending from the sole;

an external upper made of a flexible material and adapted to receive the internal liner and comprising a sole and an upper extending from the sole;

a closure system disposed on one of the internal liner and the external upper;

a reinforcing element adapted to receive the internal liner;

the reinforcement element comprising a bottom part and a top part and being disposed between the internal liner and the external upper;

the bottom part forming a heel stiffener and having a lower tightening arrangement adapted to exert a tightening force in an area of the instep;

the top part extending vertically upward from the bottom part and comprising a rear wall, an upper tightening arrangement, and two lateral walls which surround the internal liner, wherein the reinforcement element is removably fixed to the internal liner via one of the upper tightening arrangement and the closure system.

2. The boot of claim 1, wherein each of the lateral walls is equipped on a front edge with a connection element.

3. The boot of claim 1, wherein at least one of the tightening arrangement and the closure system comprises a lacing.

4. The boot of claim 3, wherein the tightening arrangement comprises keepers capable of receiving the lacing.

5. The boot of claim 1, wherein the tightening arrangement comprises a keeper and lace system.

6. The boot of claim 5, wherein the tightening arrangement further comprises a lace grip which is associated with the keeper and lace system.

7. The boot of claim 1, wherein the reinforcing element comprises a material which has a stiffness which is greater than a stiffness of the material of one of the internal liner and the external upper.

8. The boot of claim 7, wherein the reinforcing element is adapted to provide stiffness to one of the internal liner and the external upper in at least one of a transverse direction and a longitudinal direction.

9. A reinforced sports boot comprising:

at least one of, a flexible internal liner comprising a sole and an upper extending from the sole, and an external upper made of a flexible material and comprising a sole and an upper extending from the sole;

a closure system disposed on one of the internal liner and the external upper;

a reinforcing element adapted to receive one of the internal liner and the external upper;

the reinforcement element comprising a bottom part, a sole part and a top part;

the bottom part forming a heel stiffener;

the top part extending vertically upwardly from the bottom part and comprising a rear wall and two lateral walls which surround one of the internal liner and the external upper;

a binding device comprising a tightening arrangement adapted to exert a tightening force in an area of the instep; and the binding device receiving the reinforcing element, wherein the reinforcement element is removably fixed to one of the internal lining and the external upper via the closure system, and wherein the sole part is forced against the binding device when the tightening arrangements exerts a tightening force in the area of the instep.

10. A reinforced sports boot mounted to a binding device, the reinforced sports boot comprising:

a flexible internal liner comprising a sole and an upper extending from the sole;

an external upper made of a flexible material and comprising a sole and an upper extending from the sole;

a closure system disposed on one of the internal liner and the external upper;

a reinforcing element adapted to receive the external upper;

the reinforcement element comprising a bottom part, a sole part and a top part;

the bottom part forming a heel stiffener; and the top part extending vertically upwardly from the bottom part and comprising a rear wall and two lateral walls which surround one of the internal liner and the external upper;

the binding device comprising:

a tightening arrangement adapted to exert a tightening force in an area of the instep; and the binding device receiving the reinforcing element, wherein the reinforcement element is removably fixed to the external upper via the closure system, and wherein the sole part of the reinforcement element is disposed beneath the sole of the external upper when the external upper is secured to the binding device by the tightening arrangement.

* * * * *